United States Patent [19]

Johns, Jr.

[11] 3,931,687

[45] Jan. 13, 1976

[54] REAR EJECTOR ROLLER AND GUIDE FOR SCRAPER

[75] Inventor: Robert C. Johns, Jr., Lubbock, Tex.

[73] Assignee: Clark Equipment Company, Buchanan, Mich.

[22] Filed: Nov. 13, 1974

[21] Appl. No.: 523,309

[52] U.S. Cl. ..... 37/8; 37/126 AE; 104/246

[51] Int. Cl.[2] ..... B60P 1/36; E02F 9/28

[58] Field of Search ..... 37/126, 126 AB, 126 AE, 37/8; 104/106, 104, 246

[56] References Cited

UNITED STATES PATENTS

| | | | |
|---|---|---|---|
| 3,584,403 | 6/1971 | Copeland | 37/8 |
| 3,756,670 | 9/1973 | Harris | 104/246 X |

FOREIGN PATENTS OR APPLICATIONS

| | | | |
|---|---|---|---|
| 6,406,633 | 12/1965 | Netherlands | 104/106 |

*Primary Examiner*—Stephen C. Pellegrino
*Attorney, Agent, or Firm*—Jack E. Toliver

[57] ABSTRACT

An ejector roller and guide arrangement having a pair of rollers beveled on their outer edges, one on each side of the ejector frame, which travel between horizontal upper and lower tracks mounted on the pusher frame. The beveled edges of the rollers ride on inwardly angled surfaces of the track. Separate rollers on inwardly angled axes of rotation roll on separate track secured to the side walls of the bowl having outwardly angled surfaces. The longitudinally spaced rollers provide lateral and vertical guidance of the ejector in moving into and out of the scraper bowl for ejection of the earth material.

3 Claims, 4 Drawing Figures

REAR EJECTOR ROLLER AND GUIDE FOR SCRAPER

The invention herein described was made in the course of or under a contract or subcontract thereunder with the Department of the Army.

BACKGROUND OF THE INVENTION

This invention pertains to the art of mobile earth moving machines and particularly to tractor scrapers having a movable ejector for expelling earth material from the bowl.

1. Field of the Invention

Scrapers will have an ejector that is movable into the bowl for discharging the load. When uneven loads occur, the ejector will tend to bind and not move forward in parallelism with the sidewalls of the scraper unless guided in some manner. The ejector is guided in its forward and rearward travel by a trailing frame having guide rollers which travel on a track mounted on the stinger or pusher frame of the scraper.

2. Description of the Prior Art

One type of ejector guide is to use a track having a rectangular cross section and a quadrilateral arrangement of rollers traveling along the track. In certain cases, however, additional guidance has been needed such as where the continued usage in rugged terrain is to be expected.

SUMMARY OF THE INVENTION

The present invention provides an ejector roller and guide arrangement employing a pair of beveled rollers traveling with the ejector frame which are guided in a fore and aft manner on upper and lower tracks mounted on the pusher frame. The tracks have inwardly inclined surfaces that the beveled edges of the rollers ride on. In addition to the beveled rollers at the rear, a pair of rollers on each side of the ejector have their axes of rotation angled inwardly. A second track is mounted on each scraper side wall and provides upper and lower outwardly inclined surfaces for these rollers.

To provide individual adjustment, each roller may be mounted on an eccentric shaft so that the rollers may be adjusted alone, or in tandem, as required to maintain parallelism of the ejector frame and tracks.

One advantage of the ejector guide arrangement is that the beveled rollers at the rear act with the angled rollers spaced forwardly to absorb side thrust as well as up and down forces acting on the ejector at longitudinally spaced locations of the track structure distributing the loading and providing a stronger and more rigid guide arrangement.

Another advantage is that the present arrangement permits either the beveled rollers or the angled rollers to be individually adjusted by means of eccentric mountings so that any misalignment which is developed can be relieved by the adjustments.

These and other features will become apparent by referring to the following description of the invention which proceeds with the description of the drawings wherein:

DETAILED DESCRIPTION OF A PREFERRED EMBODIMENT OF THE INVENTION

Figure 1:
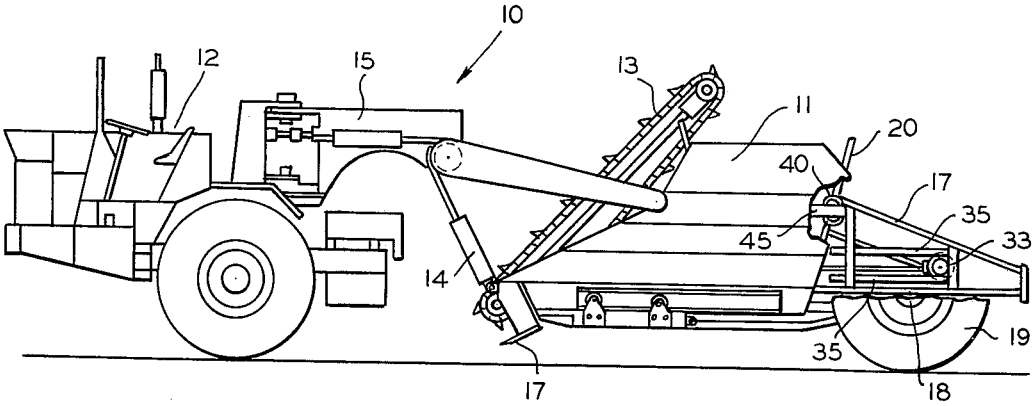
FIG. 1 is a side elevational view of a tractor scraper with the ejector retracted showing the beveled rollers and tracks at the rear and with the scraper wall partially broken away showing the angled rollers and track at the front.

Referring now to FIG. 1, 10 designates an earth moving tractor scraper having a scraper 11 towed by tractor 12. The scraper is supported at the front on a pair of hydraulic cylinders 14 pivoted to a yoke 15. The cylinders may be extended to drop the front of the scraper bowl. A blade 17 is fixed on the front edge of the bowl and will be lowered into a digging engagement with the ground when filling the bowl. A stinger or pusher frame 17 is mounted on the rear of the bowl and supports an axle 18 having ground engaging wheels 19. The bowl is closed at the rear by an ejector 20 which pushes dirt from the bowl when moved by an hydraulic actuator carried on the pusher frame. The ejector encounters uneven loads, wet or sticky material, large boulders and other loading conditions which produce side thrusts and lifting forces such that it is essential to provide a guide structure to obtain relatively smooth operation.

Figure 2:
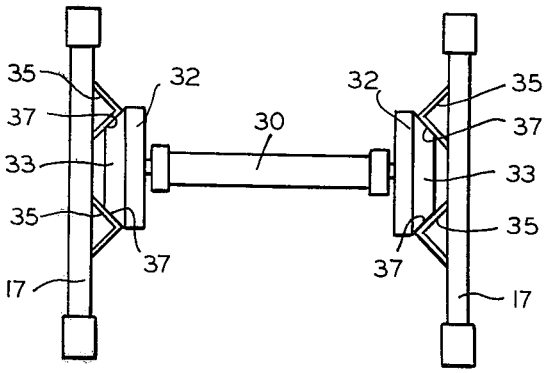
FIG. 2 is a partial view taken in cross section through the pusher frame at the rear of the scraper showing the beveled roller and track arrangement.
Figure 4:
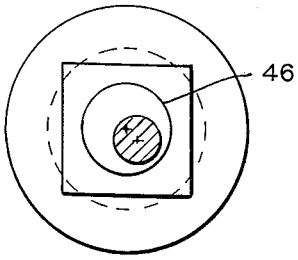
FIG. 4 is a view of one of the roller assemblies showing the eccentric mounting.
Figure 3:
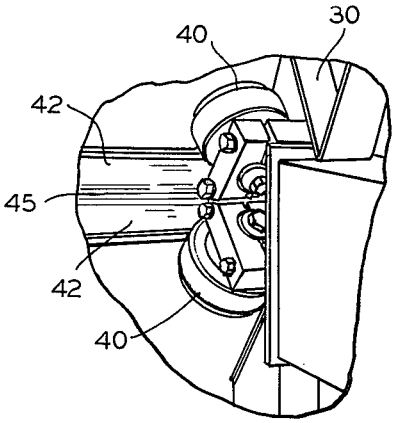
FIG. 3 is a view showing the angled rollers and track at the front.

In the present arrangement, the ejector has a rigid trailing frame 30 mounted on the rear which extends back into the pusher frame 17. The ejector frame 30 carries at its rear a pair of beveled rollers 32, one on each side, having beveled edges 33. The pusher frame carries upper and lower tracks 35 on each side, each having a horizontally extending inwardly inclined surface 37 angled such that the beveled edges 33 of the rollers run against it. In the preferred embodiment, the tracks are formed from parallel angles secured to the sides of the pusher frame to form double "V" trackways as depicted in FIG. 2 where the inwardly facing surfaces 31 are at about 45 degrees as are the beveled edges 33 of the rollers. With this arrangement, the beveled rollers 32 are trapped between the tracks 35 keeping the trailing end of the ejector frame in close lateral and vertical alignment as it moves into and out of the bowl. Spaced forwardly of the beveled rollers are pairs of rollers 40, one pair on each side, arranged with their rotational axes angled inwardly so as to roll on the upper and lower outwardly inclined surfaces 42 of a separate track 45 secured on each side wall of the bowl. The tracks 45 are formed by right angle pieces making a 45 degree surface with the side wall on which the right angled rollers will travel.

The beveled rollers 32 at the rear cooperate with the pairs of rollers spaced forwardly to better distribute the side thrust and off-center forces acting on the ejector wall so that it moves into and out of the bowl in a relatively smooth manner.

Should an adjustment be required due to wear or other factors, the beveled rollers 32, and if desired the rollers 40 as well, are mounted on an eccentric bushing 46 allowing each roller to be individually adjusted or in tandem, so as to correct any misalignment problem relative to the rollers and tracks.

While one preferred embodiment of my invention has been disclosed it will be understood that the description is for purposes of illustration only and that various modifications and changes may be made without departing from the nature of the invention which is defined in the appended claims.

I claim:

1. An earth moving scraper having sidewalls, a fixed floor portion extending between the sidewalls, an ejector extending between the sidewalls and movable into and out of the space between the sidewalls over the fixed floor portion, a rigid frame structure attached to the scraper at the rear, an ejector frame secured to and movable with the ejector and projecting rearwardly into the rigid frame structure, a pair of beveled rollers, one on each side of the ejector frame, a pair of parallel tracks, one on each side of the rigid frame structure having spaced, inclined surfaces on which the beveled edges of said rollers travel, a pair of rollers having intersecting axes of rotation mounted on each side of the ejector and spaced forwardly of said beveled rollers, a separate track on each side wall of the scraper having upper and lower inclined surfaces on which said pairs of rollers travel which together with said beveled rollers cooperate for maintaining the ejector in proper alignment while moving into and out of the space between the side wall of the scraper.

2. An earth moving scraper according to claim 1 wherein a pair of eccentric bushings rotatably mount each roller on the ejector and the axes of rotation of the pairs of rollers are offset with respect to the axis of rotation of the eccentric bushings permitting their rotational axes to be adjusted individually relative to the associated track.

3. An earth moving scraper according to claim 1 wherein the beveled rollers are beveled on their outer edges and are in rolling engagement with outwardly inclined surfaces on said parallel tracks whereas the axes of rotation of said pairs of rollers on the ejector incline inwardly at approximately right angles and the rollers are in flat rolling engagement with the upper and lower surfaces of the separate tracks on the sidewalls of the scraper.

* * * * *